US006464535B2

(12) United States Patent
Murakami et al.

(10) Patent No.: US 6,464,535 B2
(45) Date of Patent: Oct. 15, 2002

(54) WATERPROOF CONNECTOR

(75) Inventors: Takao Murakami, Shizuoka-ken (JP); Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/940,652

(22) Filed: Aug. 29, 2001

(65) Prior Publication Data

US 2002/0028603 A1 Mar. 7, 2002

(30) Foreign Application Priority Data

Sep. 4, 2000 (JP) ..... 2000-267642

(51) Int. Cl.[7] ..... H01R 13/40
(52) U.S. Cl. ..... 439/589
(58) Field of Search ..... 439/583, 589, 439/274, 275, 595

(56) References Cited

U.S. PATENT DOCUMENTS 5,529,515 A * 6/1996 Ohtaka et al. ..... 439/595
5,551,892 A * 9/1996 Endo et al. ..... 439/587
5,713,761 A * 2/1998 Okayasu et al. ..... 439/595
5,782,658 A * 7/1998 Maegawa et al. ..... 439/595
5,816,856 A * 10/1998 Kamath et al. ..... 439/595
5,931,699 A * 8/1999 Saito ..... 439/587
6,033,261 A * 3/2000 Wataka et al. ..... 439/587
6,053,753 A * 4/2000 Kunkle ..... 439/275

* cited by examiner

*Primary Examiner*—Tulsidas Patel
(74) *Attorney, Agent, or Firm*—Finnegan, Henderson, Farabow, Garrett & Dunner, L.L.P.

(57) ABSTRACT

In a waterproof connector 10 having a housing main body 11 having a plurality of terminal receiving chambers 12, a fitting portion 15 formed in the housing main body 11 and fitted to a mating housing main body, and a protecting portion 23 formed in an opposite side to the fitting portion 15 of the housing main body 11 and protecting a plurality of tube-shaped electric wire inserting portions 16 extended from the terminal receiving chamber 12, there is provided a molding sink preventing section 24 formed between the protecting portion 23 and the electric wire inserting portion 16 and all around an outer periphery of the electric wire inserting portion 16, and preventing a molding sink from being generated in the electric wire inserting portion 16 at a time of molding.

15 Claims, 4 Drawing Sheets

10
11
11a
11b
12
13
13a
13b
14
16
16a
17
17a
18
18a
18b
19
20
21
22
22
23
24
25
27
28
29
30

WATERPROOF CONNECTOR

BACKGROUND OF THE INVENTION

1. Field of the Invention

The present invention relates to a waterproof connector which improves a water proofing properties between a connector housing and a plurality of electric wires connecting terminals.

2. Description of the Related Art

The waterproof connector of this kind is constituted by a connector housing and a plurality of terminal receiving chambers provided in this connector housing, and is structured such that a male terminal connected to the electric wire is engaged with the terminal receiving chamber.

Moreover, a plurality of electric wire inserting portions extended from the terminal receiving chamber is integrally formed in the connector housing, and a wall portion in which each of the electric wire inserting portions is connected by a rib is integrally formed.

A rubber plug receiving hole receiving a waterproof rubber plug previously attached to the electric wire due to a press fit or the like is formed in each of the electric wire inserting portions.

However, in the conventional waterproof connector as described above, since the wall portion in which each of the electric wire inserting portions is connected by the rib is integrally formed, a "molding sink" is easily generated on an inner surface of each of the electric wire inserting portions at a time of being integrally formed with the connector housing, and an inner diameter of the rubber plug receiving hole is not stabilized.

Accordingly, there has been a problem that a water proofing properties between the connector housing and a plurality of electric wires connecting the male terminals by the waterproof rubber plug is reduced.

SUMMARY OF THE INVENTION

The present invention is made for the purpose of solving the problems described above, and an object of the present invention is to provide a waterproof connector which can intend to improve a water proofing property of a waterproof rubber plug.

According to a first aspect of the present invention, there is provided a waterproof connector comprising a housing main body having a plurality of terminal receiving chambers; a fitting portion formed in the housing main body and fitted to a mating housing main body; and a protecting portion formed in an opposite side to the fitting portion of the housing main body and protecting a plurality of tube-shaped electric wire inserting portions extended from the terminal receiving chamber, wherein the waterproof connector is provided with a molding sink preventing section formed between the protecting portion and the electric wire inserting portion and all around an outer periphery of the electric wire inserting portion, and preventing a molding sink from being generated in the electric wire inserting portion at a time of molding.

According to the waterproof connector, the molding sink is prevented by the molding sink preventing section formed between the electric wire inserting portion and the protecting portion and all around the outer periphery of the electric wire inserting portion from being generated in the electric wire inserting portion at a time of molding the housing main body.

Accordingly, since the inner diameter of each of the electric wire inserting portions is stabilized, it is intended to improve a water proofing property.

Moreover, the structure may be made such that the protecting portion is constituted by a tube-shaped wall portion covering an outer peripheral side of the plurality of electric wire inserting portions, and the molding sink preventing section is constructed by a space portion formed between an inner periphery of the tube-shaped wall portion and an outer periphery of the electric wire inserting portion.

According to the waterproof connector, each of the electric wire inserting portions can be protected by the tube-shaped wall portion covering the outer peripheral side of each of the electric wire inserting portions, and a rigidity and a strength of the housing main body can be secured.

Further, since the space portion is formed between the inner periphery of the tube-shaped wall portion and the outer periphery of each of the electric wire inserting portions, no connecting portion such as a rib or the like is provided between the inner periphery of the tube-shaped wall portion and the outer periphery of each of the electric wire inserting portions, so that it is possible to prevent the molding sink from being generated in each of the electric wire inserting portions at a time of forming the housing main body.

Accordingly, since the inner diameter of each of the electric wire inserting portions can be stabilized, a water proofing property can be improved.

DETAILED DESCRIPTION OF THE PREFERRED EMBODIMENT

Figure 1:
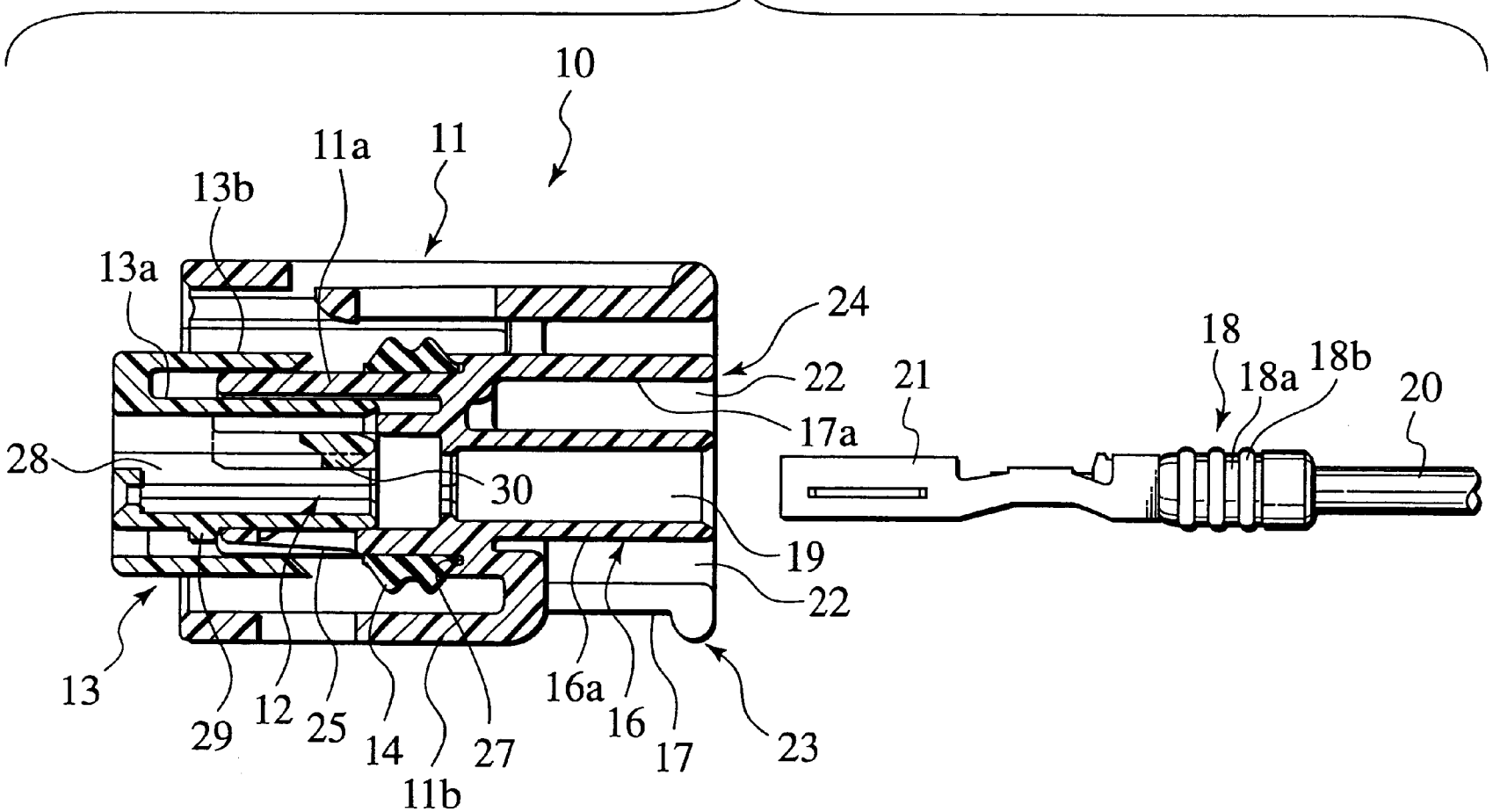
FIG. 1 is a sectional view of a waterproof connector according to an embodiment of the present invention.
Figure 2:
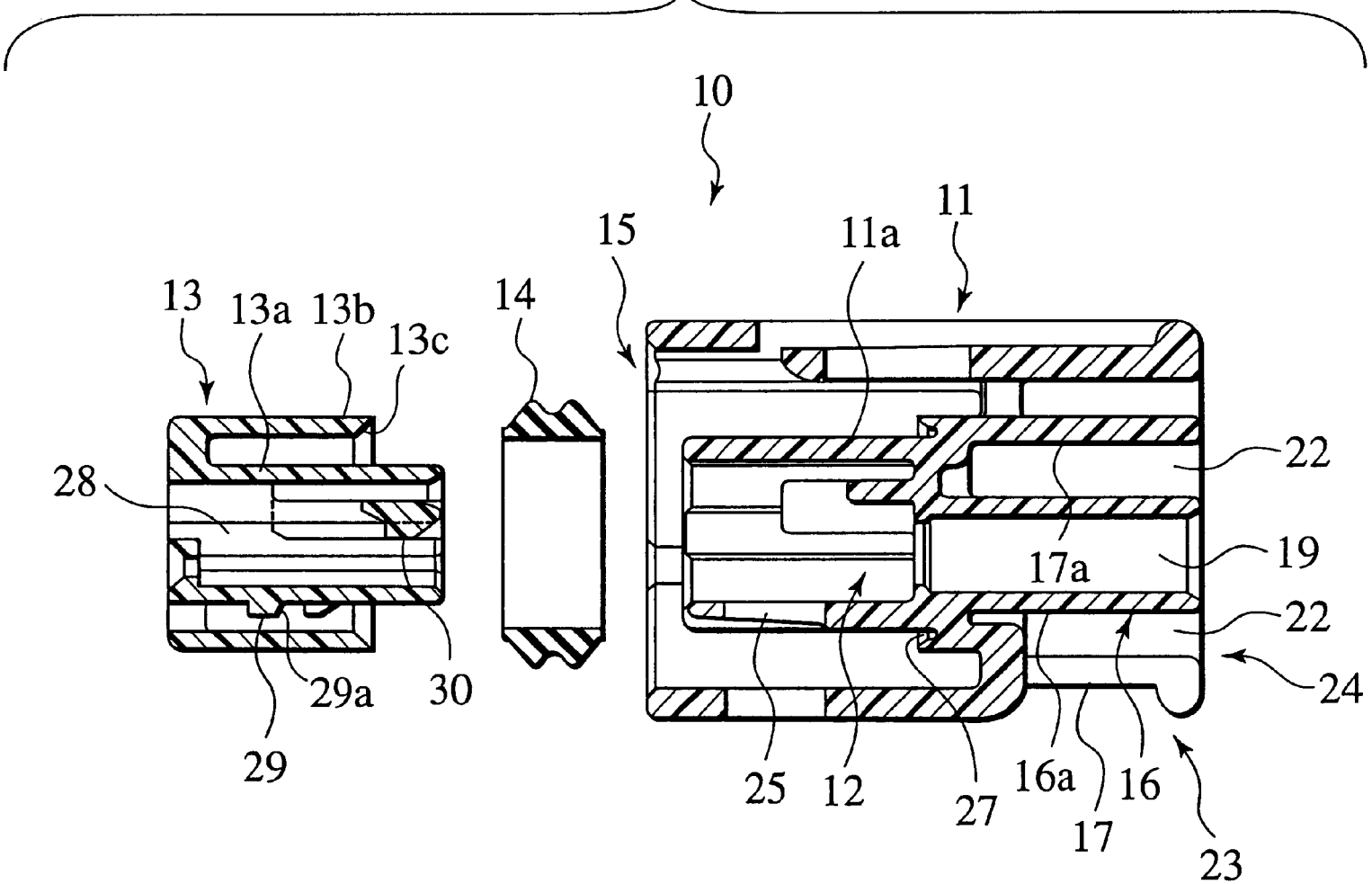
FIG. 2 is an exploded sectional view of the waterproof connection shown in FIG. 1.
Figure 3:
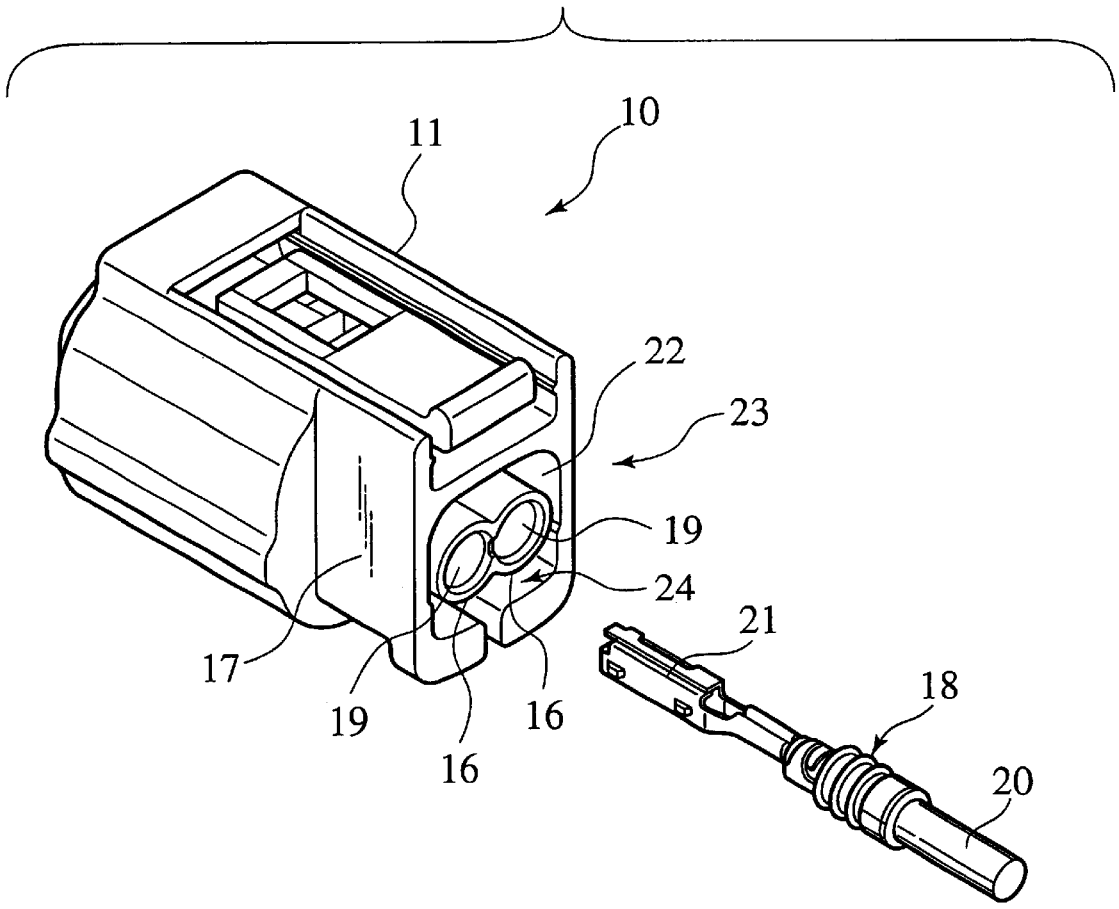
FIG. 3 is a perspective view of the waterproof connection shown in FIG. 1.
Figure 4:
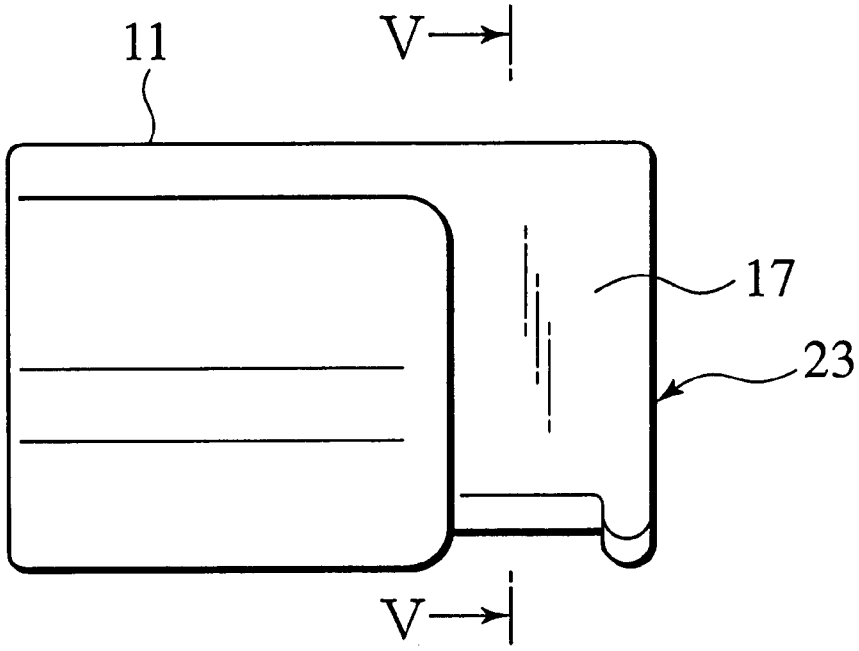
FIG. 4 is a side view of a housing main body of the waterproof connection shown in FIG. 1.
Figure 5:
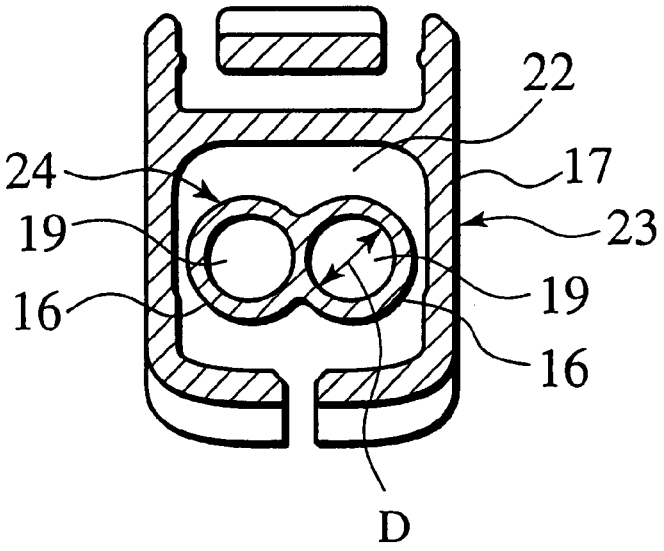
FIG. 5 is a sectional view taken along a line V—V in FIG. 4.

Hereinafter, a description will be given of an embodiment according to the present invention with reference to the accompanying drawings. As shown in FIGS. 1 to 3, a waterproof connector 10 is constituted by a synthetic resin housing main body 11 in which a plurality of terminal receiving chambers 12 are integrally formed, a synthetic resin inner housing 13 fitted to an inner portion of the housing main body 11, an annular rubber waterproof packing member 14 arranged between the inner housing 13 and the housing main body 11 so as to waterproof between the housing main body 11 and an mating side housing main body (not shown), and a female terminal 21 connected to a plurality of electric wires 20 inserted to the waterproof connector 10.

As shown in FIGS. 1 and 2, the housing main body 11 is constituted by a substantially rectangular tube-shaped inner cylinder portion 11*a* and a substantially rectangular tube-shaped outer cylinder portion 11*b* inward surrounding the inner cylinder portion 11*a* and is formed in a double box shape in which the inner cylinder portion 11*a* and the outer cylinder portion 11*b* form a fitting portion 15 fitted to a mating housing main body (not shown).

As shown in FIGS. 1 to 3 and 5, a tube-shaped electric wire inserting portion 16 extended from each of the terminal receiving chambers 12 and a tube-shaped wall portion 17 covering an outer peripheral side of the electric wire inserting portions 16 are integrally formed in a connecting portion in a rear side (an opposite side of the fitting portion 15) of the inner cylinder portion 11*a* and the outer cylinder portion 11*b*.

A rubber plug receiving hole 19 having a circular cross section in which a waterproof rubber plug 18 is received due to a press fit or the like is formed in each of the electric wire inserting portions 16. The waterproof rubber plug 18 is formed in a substantially concavo-convex cylindrical shape comprising an inner peripheral surface 18*a* and an outer peripheral surface 18b as shown in FIG. 1, and is previously attached to a side of the electric wire 20 together with a female terminal 21 due to a caulking.

Moreover, a space portion 22 is formed between an inner periphery 17*a* of the tube-shaped wall portion 17 and an outer periphery 16*a* of each of the electric wire inserting portions 16.

A protecting portion 23 for protecting each of the electric wire inserting portions 16 is constructed by the tube-shaped wall portion 17 covering an outer peripheral side of each of the electric wire inserting portions 16. Further, a molding sink preventing section 24 preventing a molding sink from being generated in each of the electric wire inserting portions 16 at a time of integrally forming with the housing main body 11 is constructed by the space portion 22 formed between the inner periphery 17*a* of the tube-shaped wall portion 17 and the outer periphery 16*a* of each of the electric wire inserting portions 16.

Moreover, an engagement hole 25 which an engagement hook 29 of the inner housing 13 is engaged with and disengaged from is formed in the inner cylinder portion 11*a* of the housing main body 11. An inclined surface 29*a* is provided in the engagement hook 29 so that a surface engaged with the housing main body 11 is easily engaged with the engagement hole 25 of the inner cylinder portion 11*a*.

Further, a packing receiving portion 27 for receiving the annular rubber packing member 14 is formed at the back of an outer surface side of the inner cylinder portion 11*a* of the housing 11.

As shown in FIGS. 1 and 2, the inner housing 13 is formed in a box shape which is open in a side of being fitted to the mating housing main body, by a substantially rectangular tube-shaped body portion 13*a* fitted to an inner surface side of the inner cylinder portion 11*a* of the housing main body 11 and a substantially rectangular tube-shaped spacer portion 13*b* formed integrally with the body portion 13*a* so as to be bent rearwards therefrom and fitted to an outer surface side of the inner cylinder portion 11*a* of the housing main body 11.

A plurality of partition walls 28 respectively sectioning the terminal receiving chambers 12 of the housing main body 11 between the adjacent terminal receiving chambers 12 are integrally formed on an inner surface of a vertical wall of the body portion 13*a*.

Moreover, the engagement hook 29 is integrally formed in a substantially center portion of the body portion 13*a*, and an engagement projection 30 engaging the female terminal 21 received in the terminal receiving chamber 12 is integrally formed in a rear end portion of the body portion 13*a*.

In the case of assembling the waterproof connector 10 according to the embodiment described above, at first, the waterproof packing member 14 is inserted to the packing receiving portion 27 of the inner cylinder portion 11*a* in the housing main body 11. At this time, the waterproof packing member 14 is positioned by the packing receiving portion 27.

Next, the body portion 13*a* of the inner housing 13 is fitted to the inner cylinder portion 11*a* of the housing main body 11, and the engagement hook 29 of the inner housing 13 is engaged with the engagement hole 25 of the inner cylinder portion 11*a* in the housing main body 11.

Moreover, at this time, a fitting side end surface of the spacer portion 13*b* in the inner housing 13 forms an inclined surface 13*c*, Accordingly, the waterproof packing member 14 is gripped and fixed by the inclined surface 13*c* and the packing receiving portion 27.

Next, the female terminal 21 connected to the electric wire 20 is inserted from the electric wire inserting portion 16 of the housing main body 11, and the female terminal 21 is received in the terminal receiving chamber 12. At this time, the female terminal 21 passes through the rubber plug receiving hole 19 provided in the housing main body, and is received in and engaged with the terminal receiving chamber 12 by the engagement projection 30 provided in the inner housing 13. Moreover, the waterproof rubber plug 18 is inserted and set to the rubber plug receiving hole 19 of the electric wire inserting portion 16 due to a press fit or the like, whereby an assembly is completed.

According to the waterproof connector 10, since the tube-shaped wall portion 17 covering the outer surface side of a plurality of electric wire inserting portions 16 is integrally formed with the housing main body 11, it is possible to protect each of the electric wire inserting portions 16 by the tube-shaped wall portion 17, and it is possible to secure a rigidity and a strength of the housing main body 11.

Further, since the space portion 22 is formed between the inner periphery 17*a* of the tube-shaped wall portion 17 and the outer periphery 16*a* of each of the electric wire inserting portions 16, and no connecting portion such as a rib or the like is provided between the inner periphery 17*a* of the tube-shaped wall portion 17 and the outer periphery 16*a* of each of the electric wire inserting portions 16, a molding sink is prevented from being generated in each of the electric wire inserting portions 16 at a time of forming the housing main body 11.

Accordingly, since an inner diameter D of the rubber plug receiving hole 19 in each of the electric wire inserting portions 16 is stabilized, it is intended to improve a water proofing properties.

What is claimed is:

1. A waterproof connector comprising:

a plurality of terminals;

at least one electric wire, each of the plurality of terminals being connected to one of the at least one electric wires; and a housing main body comprising a plurality of terminal receiving chambers, each of the plurality of terminal receiving chambers receiving one of the plurality of terminals, a fitting portion formed in the housing main body for fitting to a mating housing main body, a plurality of tube-shaped electric wire inserting portions having a length and extending from the plurality of terminal receiving chambers, a protecting portion formed opposite the fitting portion of the housing main body, the protecting portion substantially surrounding and being co-extensive with the length of the plurality of tube-shaped electric wire inserting portions in order to protect the plurality of tube-shaped electric wire inserting portions, and a molding sink preventing section comprising a space portion defined between the protecting portion and the plurality of tube-shaped electric wire inserting portions, the space portion thereby substantially surrounding the plurality of tube-shaped electric wire inserting portions, the molding sink preventing section being configured to prevent a molding sink from developing in each of the plurality of tube-shaped electric wire inserting portions during molding.

2. The waterproof connector of claim 1, wherein the protecting portion comprises a tube-shaped wall portion defining an inner periphery and extending over the plurality of tube-shaped electric wire inserting portions, and the space portion being formed between the inner periphery of the tube-shaped wall portion and the plurality of tube-shaped electric wire inserting portions.

3. The waterproof connector of claim 1, wherein the housing main body forms a double box shape, and the fitting portion comprises:

a substantially rectangular tube-shaped outer cylinder portion, and a substantially rectangular tube-shaped inner cylinder portion substantially within the substantially rectangular tube-shaped outer cylinder portion.

4. The waterproof connector of claim 3, further comprising:

an inner housing fitted to the housing main body; and an annular waterproof packing member arranged between the inner housing and the housing main body, wherein the waterproof packing member is configured to provide a substantially waterproof connection between the waterproof connector and the mating housing main body.

5. The waterproof connector of claim 4, wherein the housing main body further comprises a packing receiving portion receiving the waterproof packing member.

6. The waterproof connector of claim 4, wherein the inner housing comprises:

a body portion fitted to an inner surface of the substantially rectangular tube-shaped inner cylinder portion; and a spacer portion fitted to an outer surface of the substantially rectangular tube-shaped inner cylinder portion, wherein the body portion and the spacer portion form an open box shape for being fitted to the mating housing main body.

7. The waterproof connector of claim 6, wherein the inner housing further comprises an engagement hook in the body portion, and the substantially rectangular tube-shaped inner cylinder portion of the housing main body further comprises an engagement hole, wherein the engagement hook is configured to engage with and disengage from the engagement hole.

8. The waterproof connector of claim 6, wherein the spacer portion comprises an inclined end surface being fitted to the housing main body.

9. The waterproof connector of claim 6, wherein a partition wall for sectioning the plurality of terminal receiving chambers is provided on an inner surface of a vertical wall of the body portion.

10. A waterproof connector comprising:

a plurality of terminals;

at least one electric wire, each of the plurality of terminals being connected to one of the at least one electric wires;

a housing main body forming a double box shape, the housing main body comprising a plurality of terminal receiving chambers, each of the plurality of terminal receiving chambers receiving one of the plurality of terminals, a fitting portion formed in the housing main body for fitting to a mating housing main body, the fitting portion comprising a substantially rectangular tube-shaped outer cylinder portion, and a substantially rectangular tube-shaped inner cylinder portion substantially within the substantially rectangular tube-shaped outer cylinder portion, a plurality of tube-shaped electric wire inserting portions extending from the plurality of terminal receiving chambers, a protecting portion formed opposite the fitting portion of the housing main body, the protecting portion being configured to protect the plurality of tube-shaped electric wire inserting portions, a molding sink preventing section comprising a space portion defined between the protecting portion and the plurality of tube-shaped electric wire inserting portions, the molding sink preventing section being configured to prevent a molding sink from developing in each of the plurality of tube-shaped electric wire inserting portions during molding;

an inner housing fitted to the housing main body; and an annular waterproof packing member arranged between the inner housing and the housing main body, wherein the waterproof packing member is configured to provide a substantially waterproof connection between the waterproof connector and the mating housing main body, the inner housing has an engagement projection, and the engagement projection engages the plurality of terminals.

11. The waterproof connector of claim 1, further comprising a waterproof rubber plug attached to each of the plurality of terminals.

12. The waterproof connector of claim 11, wherein the waterproof rubber plug is formed in a substantially concavo-convex cylindrical shape comprising an inner peripheral surface and an outer peripheral surface.

13. The waterproof connector of claim 11, wherein the tube-shaped electric wire inserting portions each comprise a rubber plug receiving hole having a sectional circular form, and each of the waterproof rubber plugs is received in one of the rubber plug receiving holes.

14. The waterproof connector of claim 7, wherein the engagement hook of the inner housing comprises an inclined surface, the inclined surface being inclined in a direction of the housing main body.

15. The waterproof connector of claim 8, wherein the waterproof packing is gripped and fixed by the packing receiving portion and the inclined end surface provided in the spacer portion.

* * * * *